US006710703B2

(12) United States Patent
Huang

(10) Patent No.: US 6,710,703 B2
(45) Date of Patent: Mar. 23, 2004

(54) SIGNAL DEVICE ATTACHMENT FOR MEDICATION CONTAINER

(75) Inventor: Philip C. Huang, City of Industry, CA (US)

(73) Assignee: Max Group Corporation, City of Industry, CA (US)

( * ) Notice: Subject to any disclaimer, the term of this patent is extended or adjusted under 35 U.S.C. 154(b) by 0 days.

(21) Appl. No.: 10/074,197

(22) Filed: Feb. 12, 2002

(65) Prior Publication Data

US 2003/0151499 A1 Aug. 14, 2003

(51) Int. Cl.[7] ..... G08B 1/00

(52) U.S. Cl. ..... 340/309.16; 340/309.15; 340/309.8; 340/309.9; 368/10

(58) Field of Search ..... 340/309.16, 309.8, 340/309.9, 309.15; 368/10

(56) References Cited

U.S. PATENT DOCUMENTS

| | | | | | |
|---|---|---|---|---|---|
| 4,361,408 | A | * | 11/1982 | Wirtschafter | 368/10 |
| 5,016,230 | A | * | 5/1991 | Seifers et al. | 368/10 |
| 5,313,439 | A | * | 5/1994 | Albeck | 368/10 |
| 5,625,334 | A | * | 4/1997 | Compton | 340/309.15 |
| 5,751,661 | A | | 5/1998 | Walters | |
| 6,229,431 | B1 | | 5/2001 | Weiner | |

* cited by examiner

*Primary Examiner*—Julie Lieu
(74) *Attorney, Agent, or Firm*—Boniard I. Brown

(57) ABSTRACT

A signal device is attachable to a medication container to provide periodic signals of times for a user to take medication. The device has its electronic circuitry enclosed in a casing compressible by the user to activate the circuitry.

20 Claims, 3 Drawing Sheets

SIGNAL DEVICE ATTACHMENT FOR MEDICATION CONTAINER

BACKGROUND AND SUMMARY OF THE INVENTION

The medication signal alarm device of the present invention is contained within a unitary casing attached, as by adhesive, to a container of medication, such as pills. The battery-powered timing and signal system components are contained in the casing. The casing is preferably attached atop a lid of a container, or on a bottom of the container, as by appropriate adhesive. The casing and device may preferably be provided on a container provided by a pharmacist or physician. A particular device is being provided according to the time intervals or periods for the taking of medications by a user. The devices of the invention may typically be provided in a plurality of preset time intervals between, with a device selected for being used for a particular user.

The casing is manually compressible for activation of circuitry to effect operation of the signal device to provide the periodic signals for a user. The device may be adapted to be inexpensive and discardable after utilization by a user of a supply of medication or pills in the container to which it is attached.

The signal device of the invention is attachable to a container or the cap thereof to alert a user of the periodic times for taking medication. A casing attachable to the container or its cap contains electrical circuitry which is activated by the manual compressing of the casing. The casing is manually compressible to activate the circuitry to provide the periodic signals.

DESCRIPTION OF THE PREFERRED EMBODIMENT

Figure 1A:
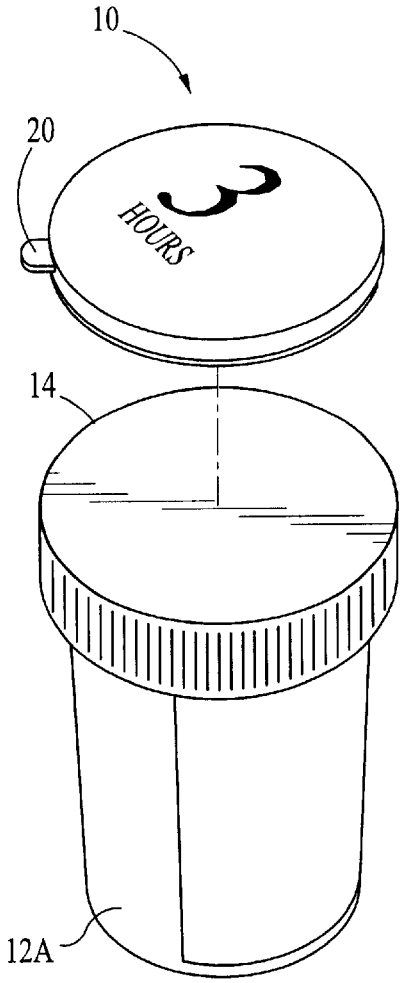
FIG. 1A is an exploded perspective view of a signal device according to the invention and a container of medication to which it is attachable.
Figure 1B:
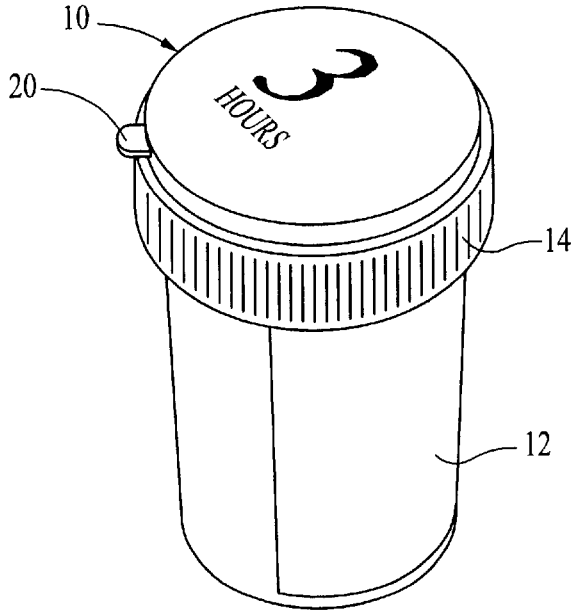
FIG. 1B is a perspective view of the device of the invention mounted on a lid of the container.
Figure 2:
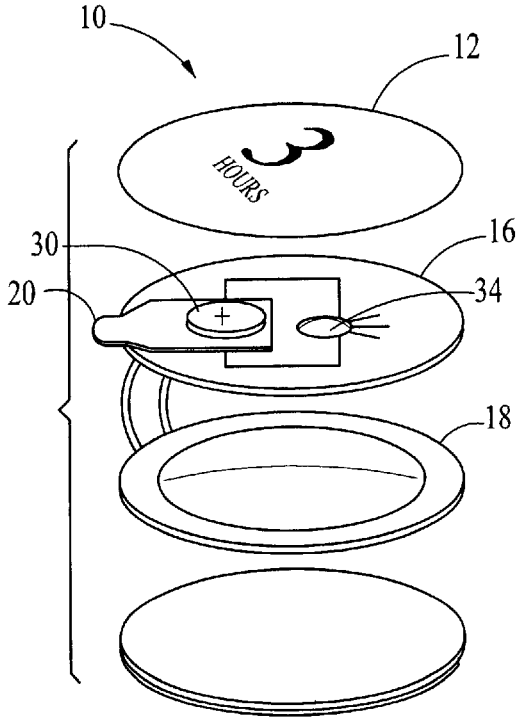
FIG. 2 is an exploded perspective view showing components of the signal device of the invention.
Figure 3:
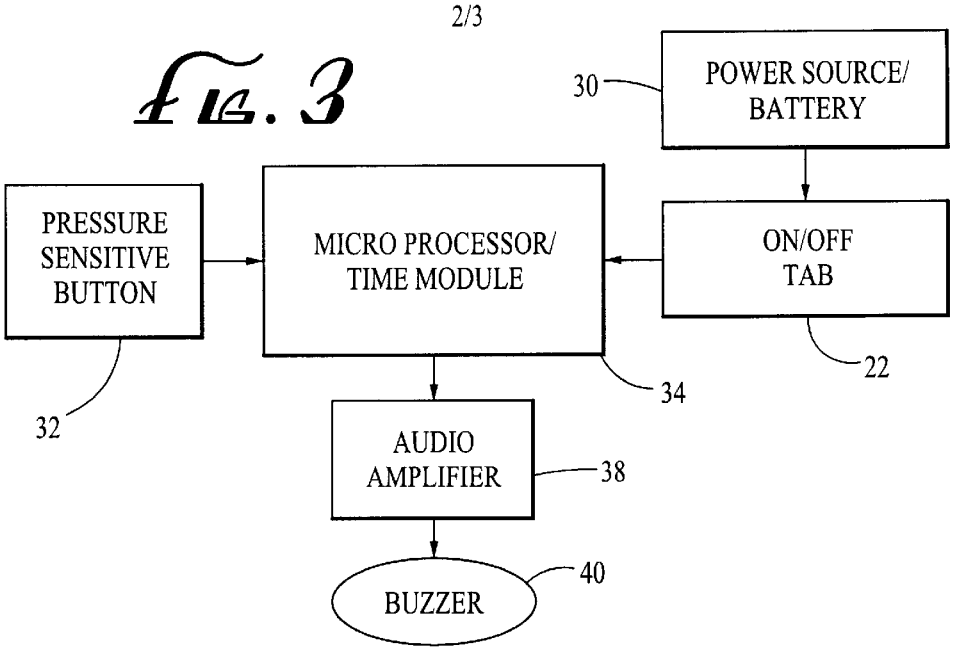
FIGS. 3 and 4 are illustrations in block diagram form of circuitry of the signal device according to the invention.

Referring to the drawings, FIGS. 1A, 1B and 2 show a signal device according to the invention in relation to a container 12 of pills or other medication. FIGS. 1A and 1B are perspective views and FIG. 3 is an exploded perspective view of a signal device 10 of the invention in relation to a cover 12 of a container 12A. The exploded perspective view of FIG. 2 shows the device of the invention as comprising a cover member 14, a circuit board 16, a buzzer or signal device 18, and a bottom wall member 20. An outwardly extending tab member 22 engages the circuit board for a purpose hereinafter described.

The signal device 10 is preferably or a generally circular configuration, as shown, and is formed of an elastic-memory material, preferrably an inexpensive, tough polymer such as polypropylene. Such material enables the manual pressing or squeezing of the casing to effect electrical contact between components to energize and initiate operation of the circuitry within the casing.

Figure 4:
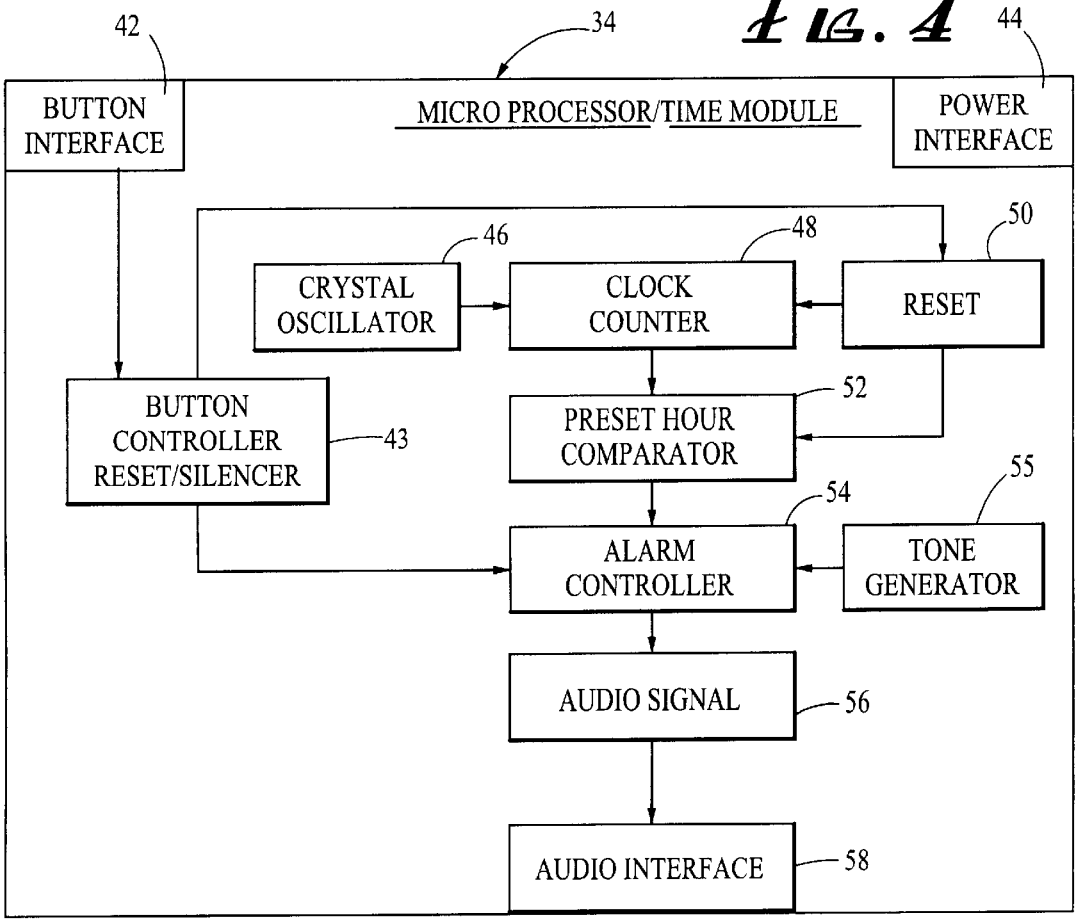

FIGS. 3 and 4 illustrate the circuitry arrangement of the invention in block diagram form.

The electronic components utilized with the invention are known to those versed in the relevant arts, and therefore are not illustrated and described herein in detail. Such components are available on the market, and certain thereof are commonly utilized in timekeeping devices. The circuitry and its components may preferably be provided in integrated printed circuitry.

The circuitry comprises a power source or battery 30. A tab 22 is manually operable to activate the circuitry by connecting components separated by the tab during storage, shipping, etc., to prevent loss of battery power.

The battery or power source 30 is connected with a microprocessor/time module 34 which is actuated by a pressure-sensitive button 32 operable to activate the microprocessor/time module 34, the pressure sensitive button being operable by manual compression of the outer casing of signal device 10. The microprocessor/time module is connected with an audio amplifier 38 which is connected to signal device or buzzer 18. The power source is connected at power interface 44 (FIG. 4), and the pressure-sensitive button is connected to button interface 42. A button controller 43 for resetting and silencing the system is interconnected between button interface 42 and an alarm controller 54.

A crystal-controlled oscillator 46 is connected to a clock counter 48 controlled by a reset 50 which is also connected to control a preset hour comparitor 52, as shown in FIG. 4. The clock counter may preferrably be non-programmable and preset by manufacturer of the system. The preset hour comparitor 52 is connected to an alarm controller 54 to receive input from a tone generator 55 which provides input to an audio signal device 56 which provides input to an audio interface 58 for an output signal.

The oscillator and clock counter or timer means comprise integrated microprosessor circuitry for the storing of information on time intervals between spaced-apart periodic signal output. The oscillator may typically have a frequency of 60 cycles per minute and is connected to the clock counter 48 which counts-down second-by-second. As an example, with the clock counter set for 8 hours between periodic output signals and the counter set for 28,800 cycles, a signal alarm from audio signal device 56 is set off by the counter, and the counter starts going back from "zero" cycles.

An audible sound signal is provided by an audio amplifier 38, because the audio signal from the tone generator is typically a weak signal.

The circuitry utilized with the present invention thus provides preset time intervals in accordance with the appropriate or prescribed intervals for a particular user.

In utilizing the signal device of the invention, a user exerts manual pressure on the casing, typically at the center thereof, to compress the flexible casing to direct operation of the pressure-sensitive button 34 to effect electrical connection, the user maintaining pressure on the casing for typically three seconds to activate circuitry. The electronic circuitry is thus set to "zero" to commence the time interval for next time for taking medication. The time interval can vary widely for different persons, in accordance with a preset medication schedule. Such intervals may typically be 2, 4, 6 and 8 hrs.

At the expiration of the time interval, the audio output signal, as from a buzzer, continues to provide signals until the user resets it by pressing the reset by compressing the casing. The user thus presses the casing of the device to reset it to provide a signal upon the expiration of the next time interval for the taking of the medication.

Figure 5:
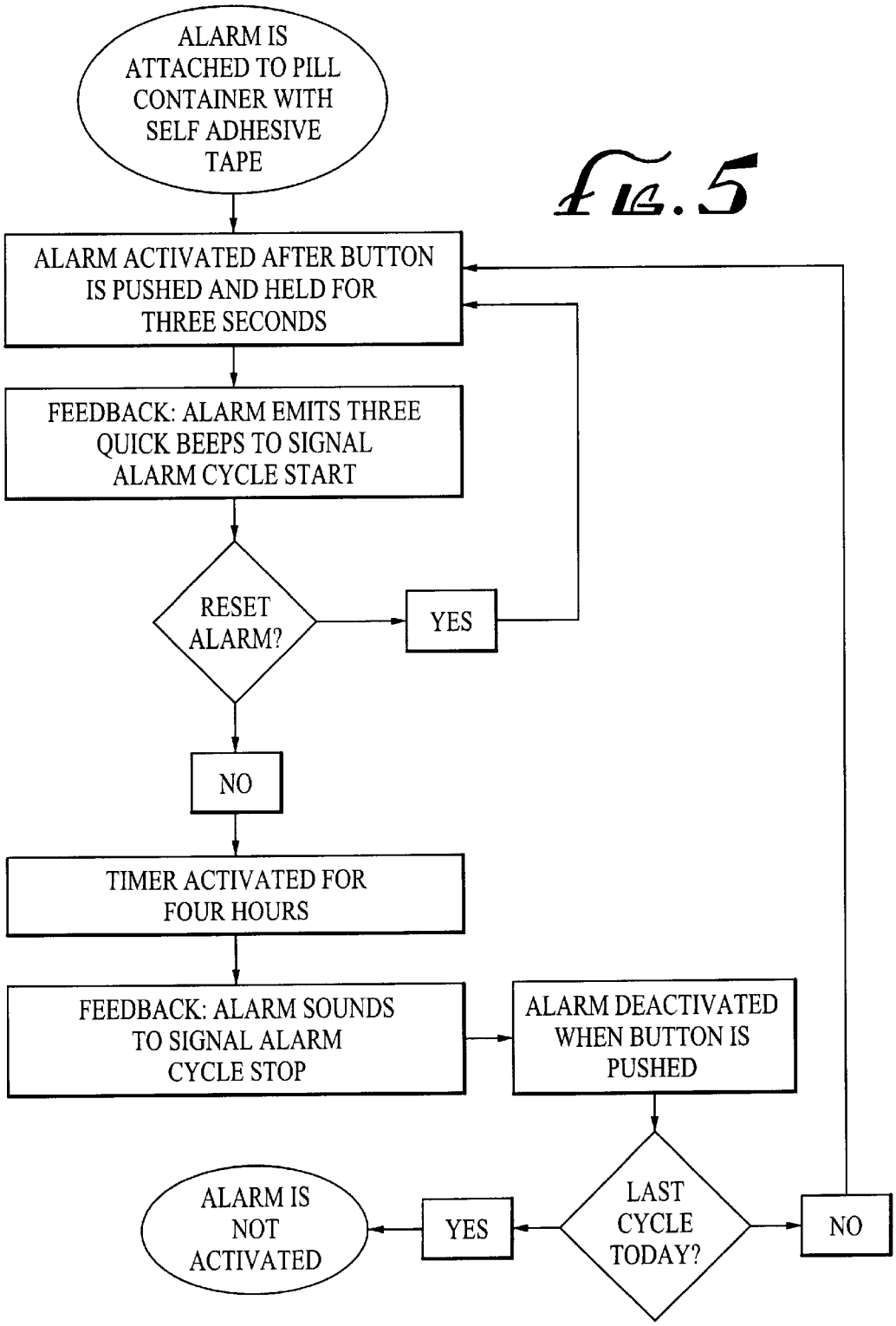
FIG. 5 is a block diagram illustration of the sequence of operation of the components of the device of the invention.

The flow chart of FIG. 5 shows the steps and utilization of the device of the invention. The signal or alarm device is attached to the pill or medication container by self-adhesive tape. The button is pushed by the user and is held, by compressing the casing, for three seconds, whereupon three quick beeps signal the commencement of an alarm cycle. If necessary, the signal device may be reset by again compressing the casing. If there is no reset, the timer is activated for a period of, say, four hours after which the alarm system sounds. The alarm is deactivated by pressing the casing, if the last period for taking medication for a particular day has occurred or the alarm is not activated.

In utilizing the device of the invention, the user must first read and understand the instructions for utilizing the device of the invention. The user attaches the signal device or alarm to the pill container, typically onto the lid or cover of the container, although attachment may be elsewhere on a container. The user takes the medication or pills, and activates the system to begin a first cycle of device operation. The device is thus activated by compression of the casing, and maintaining pressure for three seconds, thus to set the system for a first periodic taking of medication.

It will be understood that various changes and modifications may be made from the preferred embodiments discussed above without departing from the scope of the present invention, which is established by the following claims and equivalents thereof.

What is claimed is:

1. A signal device for a medication container to alert a user times for taking medication, said signal device comprising:

a casing removably attachable to a container of the medication, said casing being formed of an elastic-memory material, electrical circuitry disposed in paid casing, said circuitry comprising a power source, timer means, and signal electronics to generate periodic signals at time intervals to communicate to a user of said medication the times for taking the medication, and means comprising a pressure sensitive button in the casing operable to manually activate said circuitry.

2. A signal device according to claim 1, wherein said casing is adhesively attachable to the container.

3. A signal device for a medication container to alert a user of times for taking medication, said signal device comprising:

a casing attachable to a container of the medication, electrical circuitry disposed in said casing, said circuitry comprising a power source, timer means, and signal electronics to generate periodic signals at time intervals to communicate to a user of said medication the times for taking the medication, and wherein said casing is manually compressible to activate the circuitry to effect operation of the signal device to provide said periodic signals.

4. A signal device according to claim 3, wherein said container comprises a cap and said casing is adhesively attachable to the cap.

5. A signal device according to claim 2, wherein the container is sized and adapted to accommodate a supply of medication, and has an openable top for insertion and removal of medication.

6. A signal device according to claim 1, wherein said power source comprises a battery.

7. A signal device according to claim 1, wherein said generated signals are audible signals.

8. A signal device according to claim 1, wherein the circuitry comprises memory means for storing information regarding said time intervals, and pressure-sensitive contact means operable by manual compression of said casing to activate said circuitry.

9. A signal device according to claim 1, wherein the timer means comprises integrated microprocessor circuitry for storing information regarding time intervals between output signals.

10. A signal device according to claim 9, wherein said time intervals are preset by a manufacturer and are not adjustable by the user.

11. A signal device for a medication container to alert a user of times for taking the medication, said device comprising:

a casing adapted to contain electronic circuitry to generate spaced-apart signals to alert a user of periodic time intervals for the taking of the medication, said casing being manually compressible to actuate the circuitry, said electronic circuitry comprising a power source, timer means, signal electronics, output means connected with the signal electronics to output signal information, and a signal device responsive to the signal information to provide periodic signals to the user to communicate the times when medication is to be taken, and switch means for manually activating the said electronic circuitry.

12. A signal device according to claim 11, wherein said casing is generally circular and is adhesively attachable to the container.

13. A signal device for a medication container to alert a user of times for taking the medication, said device comprising:

a casing adapted to contain electronic circuitry to generate spaced-apart signals to alert a user of periodic time intervals for the taking of the medication, said electronic circuitry comprising a power source, timer means, signal electronics, output means connected with the signal electronics to output signal information, and a signal device responsive to the signal information to provide periodic signals to the user to communicate the times when medication is to be taken, and said casing being manually compressible to activate the circuitry to effect operation of the signal device to provide said periodic signals.

14. A signal device according to claim 12, wherein said container comprises a cap, and a casing is formed of elastic-memory material.

15. A signal device according to claim 11, wherein the container is sized and adapted to accommodate a supply of medication, and has an open top for insertion and removal of medication.

16. A signal device according to claim 11, wherein said power source comprises a battery.

17. A signal device according to claim 11, wherein said generated signals are audible signals.

18. A signal device according to claim 11, wherein the circuitry comprises memory means for storing information regarding said time intervals.

19. A signal device according to claim 11, wherein the timer means comprises integrated microprocessor circuitry for storing information regarding time intervals between output signals.

20. A signal device according to claim 19, wherein said time intervals are preset by a manufacturer and are not adjustable by the user.

* * * * *